US005219445A

United States Patent [19]

Bartenbach

[11] Patent Number: 5,219,445

[45] Date of Patent: Jun. 15, 1993

[54] ILLUMINATING APPARATUS

[76] Inventor: Christian Bartenbach, Rinnerstrasse 14, A-6071 Aldrans, Austria

[21] Appl. No.: 768,058

[22] Filed: Sep. 27, 1991

[30] Foreign Application Priority Data

Oct. 4, 1990 [DE] Fed. Rep. of Germany ..... 4031302

[51] Int. Cl.[5] ..... F21V 7/00

[52] U.S. Cl. ..... 362/341; 362/322; 362/346; 362/348; 359/851

[58] Field of Search ..... 362/296, 297, 341, 346, 362/347, 348, 350, 33, 322; 359/851, 852, 867

[56] References Cited

U.S. PATENT DOCUMENTS

| | | | |
|---|---|---|---|
| 569,503 | 10/1896 | Keyes | 359/851 |
| 2,471,954 | 5/1949 | Harvey | 362/346 |
| 2,968,033 | 1/1961 | Kreitzberg | 362/346 |
| 4,250,537 | 2/1981 | Roegner et al. | 362/347 |
| 5,117,343 | 5/1992 | Kerscher et al. | 362/347 |

FOREIGN PATENT DOCUMENTS 627252 12/1981 Switzerland .

*Primary Examiner*—Ira S. Lazarus
*Assistant Examiner*—Y. Quach
*Attorney, Agent, or Firm*—Peter K. Kontler

[57] ABSTRACT

An illuminating apparatus wherein light which is emitted by one or more projectors is divided into light beams by reflectors or lenses and is directed against the surface to be illuminated by an array of neighboring luminant spots in such a way that the eye of an observer looking at the spots from the surface to be illuminated is not affected by glare, that the surface is adequately illuminated, and that the eye can discern discrete luminant spots. This is accomplished by causing several light beams to impinge upon each unit area of the surface to be illuminated and by appropriate selection of the distance of the surface to be illuminated from the luminant spots as well as by appropriate selection of maximum dimensions of the spots and their mutual spacing in the array.

22 Claims, 4 Drawing Sheets

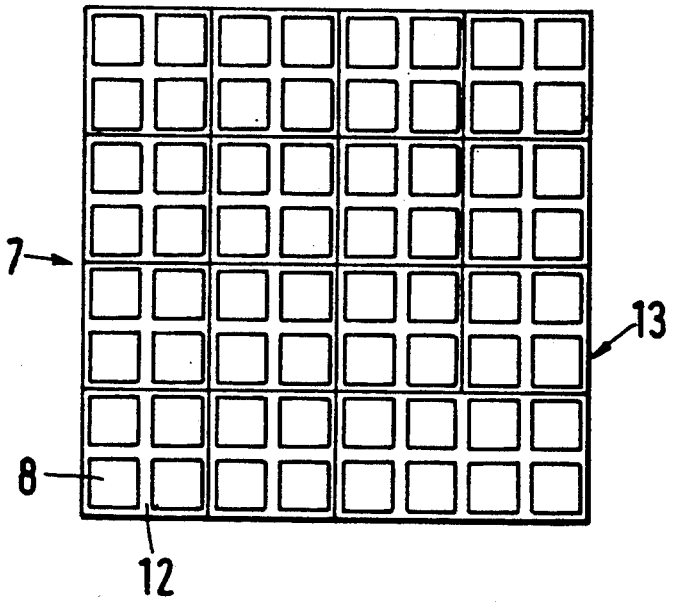
Fig.4
Fig.5
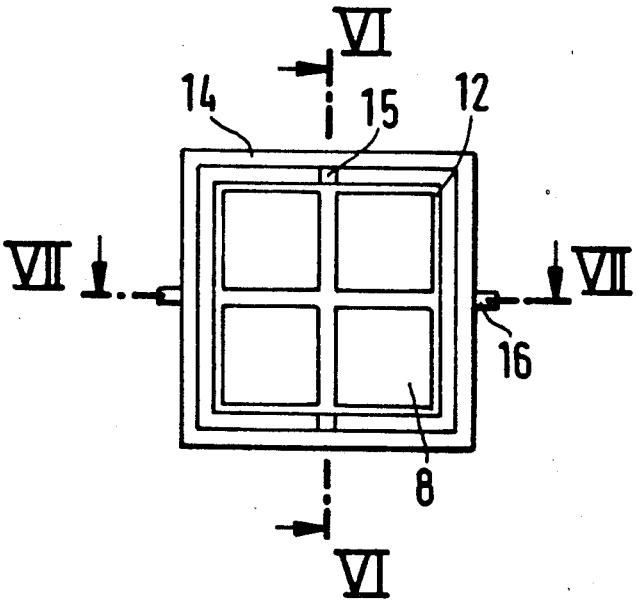
Fig.6
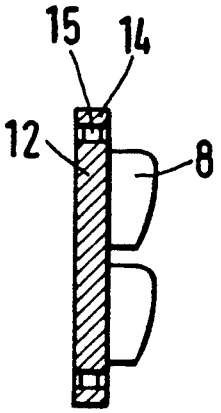
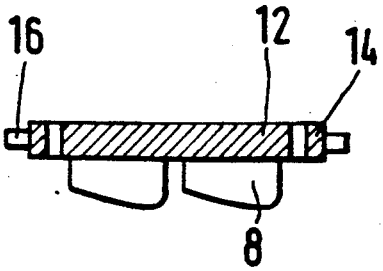
Fig.7

ILLUMINATING APPARATUS

BACKGROUND OF THE INVENTION

The invention relates to illuminating apparatus in general, and more particularly to improvements in illuminating apparatus of the type described in commonly owned Swiss Pat. No. 627 252 granted Dec. 31, 1981.

The illuminating apparatus which is described in the Swiss patent comprises a light source and an optical system which divides light issuing from the source into a plurality of beams and directs the light beams against the surface which is to be illuminated. The arrangement is such that several light beams impinge upon each unit area of the surface to be illuminated and that discrete luminant spots are observable at the light directing or emitting side of the optical system. The light source is an incandescent lamp, and the optical system comprises a plurality of discrete reflectors. Each reflector is configurated and dimensioned in such a way that the reflected light illuminates the entire surface to be illuminated. An observer of the optical system see the image of the light source in each individual reflector; however, the intensity of light which is reflected by each reflector is merely a minute fraction of the intensity of light issuing from the source, namely a fraction of the overall light intensity (such fraction equals the overall intensity divided by the number of individual reflectors). The just discussed reduction of light intensity is intended to reduce the likelihood of glare.

The patented illuminating apparatus is quite satisfactory when the area of the surface to be illuminated (and hence of the volume of the space which requires illumination) does not exceed a predetermined value. However, the patented apparatus is less effective for illumination of large surfaces and areas, such as uncovered outdoors surfaces or large halls of the type erected in assembly, manufacturing and other plants. The reason is that the intensity of light does not suffice to ensure adequate illumination. If the intensity or brightness of light which is emitted by the light source is increased (an undertaking which is readily achievable by resorting to recently developed types of light sources), the aforediscussed desirable and advantageous effect of reduced light intensity of the image of light source in the reflector is eliminated and the observer of the optical system detects pronounced glare.

In setting up an effective illuminating apparatus, the designer must take into consideration a plurality of important parameters. One of these parameters is the distance of the apparatus from the surface to be illuminated; such distance must be selected with a view to ensure that the apparatus furnishes requisite amounts of light to achieve a desirable brightness. The required brightness will depend upon a variety of factors. For example, if the apparatus is to illuminate the interior of a hall in an assembly plant or in a manufacturing plant wherein the assembly work or manufacturing work must be visually inspected, the required brightness is much more pronounced than when the apparatus is to illuminate a large outdoor area such as a parking area or a railroad freight yard. It is further necessary to take into consideration that the eyes of persons in the area to be illuminated are not always located at the level of the surface to be illuminated. This will be readily appreciated by assuming that the surface to be illuminated is that of a floor. The illuminating apparatus is installed at a level above the floor so that the eyes of persons walking on the floor are disposed at a distance of approximately 1.5–2 meters from (above) the illuminated surface, i.e., nearer to the illuminating apparatus than the floor. The problems which arise due to the difference between the distance of the illuminating apparatus from the illuminated surface on the one hand and the distance of the illuminating apparatus from the eyes of the persons working in the area above the illuminated surface are much more acute if the difference exceeds or greatly exceeds the aforediscussed distance of 1.5–2 meters. This is the situation when one or more persons must occupy the mobile cabin of a crane or a like machine which can move the cabin to or from a level well above the floor or when one or more persons must occupy a conveyance or a platform which is installed at a level above the floor Analogously, the eye of a person who occupies the driver's seat of a truck or a like large vehicle is located at a distance of approximately three meters above the road surface, i.e., much closer to the apparatus which illuminates the road. In order to adequately solve the just discussed problems, it is necessary to design the illuminating apparatus by full consideration of the distance of the eye or eyes of one or more persons from the surface which is to be illuminated. Such persons are those who are in position to accidentally or intentionally look at the illuminating apparatus and who are to be shielded from glare.

Shielding of the eyes of persons who happen to or must occupy illuminated areas is an important problem, i.e., glare should be avoided in order to enable the persons to function properly and to avoid accidents or damage to their eyes. At the same time, the illuminating apparatus must ensure that the area which is to be illuminated is sufficiently bright. As a rule, a person will detect and will be inconvenienced by glare when certain parts of the illuminating apparatus, such as the light source, the reflectors or their holders and certain reflecting objects (such as metallic parts, white surfaces or a wet floor covering) are much brighter to the observer than their surroundings.

OBJECTS OF THE INVENTION

An object of the invention is to provide an apparatus which is capable of brightly illuminating a small or a large area without glare.

Another object of the invention is to provide a novel and improved optical system for use in the above outlined apparatus.

A further object of the invention is to provide a novel and improved array of reflectors for use in the above outlined apparatus.

An additional object of the invention is to provide a novel and improved array of light transmitting optical elements for use in the above outlined apparatus.

Still another object of the invention is to provide a novel and improved method of selecting the distances between the optical elements of the above outlined illuminating apparatus.

A further object of the invention is to provide an apparatus which can prevent glare even if it is called upon to brightly illuminate large outdoor or indoor areas such as parking areas, halls in manufacturing or assembly plants, freight yards at railroad stations and many others.

Another object of the invention is to provide an apparatus which is effective to avoid glare under circumstances when the surface which is being illuminated is located at a considerable distance from the eye or eyes of one or more persons occupying the area next to the illuminated surface.

SUMMARY OF THE INVENTION

The invention is embodied in an apparatus for illuminating a surface. The improved apparatus comprises a light source, and optical means for dividing light which issues from the source into light beams. The light dividing means includes means for directing against each unit area of the surface to be illuminated a plurality of light beams, and such directing means has at least one array of luminant light directing spots which are disposed at a first distance from the surface. Each spot has a maximum dimension which is a function of the first distance, and the neighboring spots of the at least one array of spots are spaced apart from each other a second distance which is sufficient to render the spots distinguishable to the eye of an observer at the first distance.

The maximum dimension of each spot is further dependent upon the nature of the luminescent substance the light source.

The maximum dimension of each spot can be defined by the equation $D=2\times a\times \tan(x/2)$, wherein D is the maximum dimension of a spot, a is the first distance in meters, and x equals $-1/g\times \ln(K-B)/(K-1)-s$. In the second equation, x is measure in angular minutes, g is a constant not less than 0.5 but not greater than 0.9, K is a factor not less than 6 and not more than 9, B is a factor not less than one and not greater than six, and s is a constant not less than zero and not greater than 0.3.

The factor B is a function of permissible glare to the eye of an observer at the first distance from the spots; in many instances, B will be selected to at most equal 5, preferably not more than 4.

The second distance b (i.e., the mutual spacing of neighboring spots) is preferably selected in accordance with the equation $b=2\times a\times \tan(y/2)$, wherein a is the first distance in meters and y equals or exceeds ten angular minutes.

In accordance with one presently preferred embodiment, the light dividing means includes at least one set of preferably adjustable light reflectors. Such at least one set can include a plurality of groups of reflectors, and the reflectors of each group are preferably or can be adjustable as a unit. The light dividing means can further comprise a holder for each group of reflectors, a frame for the holders, and means for movably mounting the holders in the frame. Such mounting means can include means for facilitating movements of each holder in a plurality of different directions and the facilitating means can include a plurality of pivot members for each holder. The axes of the pivot members can extend through the central portions of the respective holders. Each group can comprise between four and eight reflectors. At least some of the reflectors can be provided with substantially concave light reflecting surfaces.

The light source can comprise a plurality of projectors, and such projectors can be spaced apart from each other.

In accordance with another presently preferred embodiment of the invention, the light dividing means comprises a set of lenses. Such set can comprise discrete lenses and at least some of the lenses are preferably adjustable to change the orientation of their optical axes. The lenses can be adjustable individually or in groups of two or more.

The light source is preferably designed to emit light having a density of at least 100,000 candles or candles per square meter.

The novel features which are considered as characteristic of the invention are set forth in particular in the appended claims. The improved illuminating apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 4 is a schematic front elevational view of an optical system with sixty four reflectors which can be utilized in the apparatus of FIG. 1;

FIG. 5 is an enlarged front elevational view of a group of four reflectors forming part of the optical system of FIG. 4, and further showing the means for movably mounting the reflectors in the frame of the optical system;

FIG. 6 is a sectional view substantially as seen in the direction of arrows from the line VI—VI in FIG. 5;

FIG. 7 is a sectional view substantially as seen in the direction of arrows from the line VII—VII of FIG. 5.

DESCRIPTION OF PREFERRED EMBODIMENTS

Figure 1:
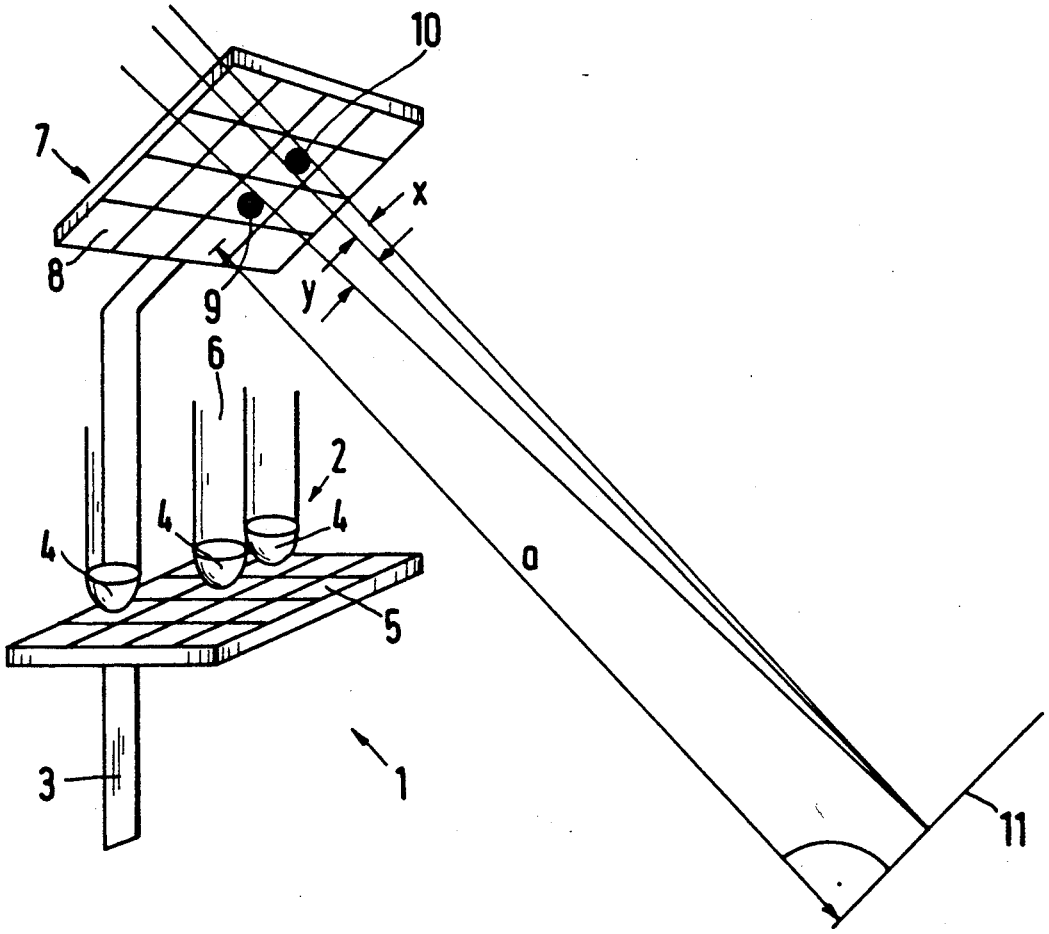
FIG. 1 is a fragmentary schematic perspective view of an illuminating apparatus which embodies one form of the invention and wherein the light source is located at a level beneath an optical system employing a plurality of reflectors.

FIG. 1 shows an illuminating apparatus 1 which embodies one form of the present invention and serves to illuminate a surface 11 and the area adjacent the surface. The apparatus 1 comprises a light source 2 which is mounted on a support 3 in the form of a column or mast 3. The illustrated light source 2 comprises a large number of projectors 4 of which only three are actually shown in FIG. 1 and each of which directs a light beam 6 against at least one reflector 8 forming part of an optical light dividing and light directing system 7. The projectors 4 are mounted on a platform 5 which is carried by an intermediate portion of the support 3, namely at a level beneath the optical system 7. The orientation of illustrated projectors 4 is such that they direct light beams 6 vertically upwardly, and the dimensions of the optical system 7 are preferably such that it intercepts all or practically all radiation issuing from the source 2. Some radiation issuing from those projectors 4 which are adjacent the edges of the platform 5 might bypass the corresponding reflectors 8 of the optical system 7.

The reflectors 8 of the optical system 7 which is shown in FIG. 1 preferably have concave light reflecting surfaces. The optical system 7 of FIG. 1 comprises a rectangular or square array or set of sixteen reflectors 8 which form four rows; however, in actual practice, the number of reflectors will be much larger, particularly at least one hundred (for example, four hundred). The feature that the reflectors 8 have concave light reflecting surfaces ensures that the reflectors reflect smaller-scale virtual images of the projectors 4. The eye of an observer which is located at the surface 11 to be illuminated at a distance a from the reflectors 8 perceives the virtual reflected images of the projectors 4 as luminant spots of which two are shown (at 9 and 10) in FIG. 1. Since the eye sees several discrete reflectors 8 at the same time, such eye simultaneously perceives a corresponding number of luminant spots 9 and 10. Thus, that unit area or point of the surface 11 at which the eye of an observer is located is simultaneously illuminated by a plurality of light beams which are reflected by the perceived reflectors 8. This, in turn, ensures that the brightness of the just discussed unit area or point of the surface 11 is satisfactory.

Figure 2:
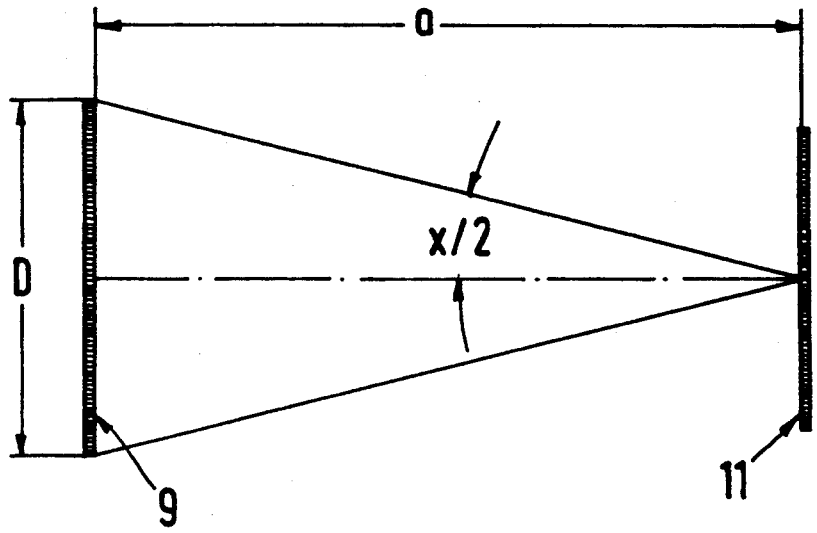
FIG. 2 is a diagrammatic view of a luminant spot and of its distance from the surface to be illuminated as well as of an angle which is to be considered in determining the maximum dimensions of the luminant spot.

The individual reflectors 8 are designed in such a way that the maximum dimension D (FIG. 2) of each reflector is below a predetermined value. If the spot 9 of FIG. 2 is round, the maximum dimension D is the diameter of such spot. Of course, the reflectors 8 need not always be designed in such a way that the luminant spots 9, 10 have a circular or substantially circular shape. It has been ascertained that the maximum permissible dimensions D of a luminant spot 9 or 10 can be calculated in accordance with the equation $D=2\times a\times \tan(x/2)$ wherein a is the distance of the responsive spot 9 or 10 from the surface 11 (measured in meters) and x is measured in angular minutes and is calculated in accordance with the equation $$x=\times x1n(K-B)/(K-1)-s,$$

wherein the values of g, K and s are dependent upon the nature of luminant substance or substances (e.g., halogen, sodium or mercury) which are used in the light source 2. As a rule, the values of g, K, B (subjective glare factor) and s are as follows:

$$0.5\leqq g\leqq 0.9$$

$$6\leqq K\leqq 9,$$

$$1\leqq B\leqq 6, \text{ and}$$

$$0\leqq s\leqq 0.3.$$

The value of the factor B is selected in dependency upon the subjective sensation of glare by an observer whose eye is located at the distance a from the reflectors 8 of the optical system 7. The factor B=1 denotes nondetectable or nonexistent glare whereas the factor B=6 denotes the upper limit of bearable or acceptable glare. Selection of the factor B will be dependent upon the prescribed, required or desired safety in the area at the illuminated surface 11. In cases when the sensation of glare at the upper limit of the acceptable or bearable value would be likely to be dangerous to the persons operating in the illuminated area, the factor B will be selected to be between one and four. The sensation of glare is nil or practically nil if B=1. Under certain other circumstances, when a light which is plainly bright to an observer is still acceptable because it does not cause or produce glare, the value of the factor B can be as high as six. Nevertheless, even under such circumstances the value of B is preferably selected to be in the range of five for the sake of safety and comfort, e.g., because the eyes of one or more persons in a group of persons who are active in the illuminated area might be more sensitive to glare than the others. At any rate, selection of a factor B=6 is still within the purview of the invention because it does not invariably or necessarily entail the development of glare which is unbearable to an observer.

As mentioned above, the values of the factors g, K and s are dependent upon the nature of the luminant substance or substances which are used in the light source 2. For example, if the light source 2 comprises one or more halogen lamps, the value of g is between 0.5 and 0.7 and can equal or approximate 0.58, K is between 8 and 9 and can equal or approximate 8.42 and s is between 0.01 and 0.03 and can be in the range of 0.02. The value of K is reduced and the value of s is increased if a light source using one or more halogen lamps is replaced with a light source using one or more high-pressure sodium vapor lamps. If the light source contains one or more high-pressure mercury vapor lamps, the value of g is higher, the value of K is less than for halogen lamps and is preferably between those for halogen lamps and sodium vapor lamps, and the value of s is below that for halogen or sodium vapor lamps.

Exact values of g, K and s for each of a variety of available and suitable light sources can be ascertained on the basis of rather simple experimentation, for example, by ascertaining the glare as sensed by a certain number of persons.

Figure 3:
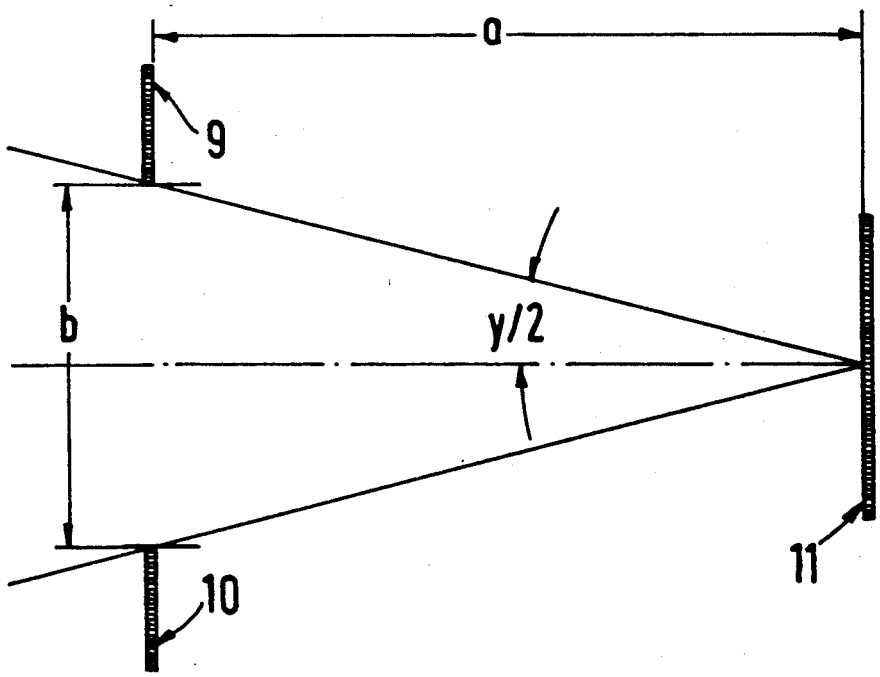
FIG. 3 is a similar diagrammatic view but showing two neighboring luminant spots and certain parameters which must be taken into consideration for determination of the distance of neighboring luminant spots from each other.

The areas of the luminant spots 9 and 10 are selected in such a way that the observer sees a large number of bright spots but that each spot is perceived as a flickering or flashing spot. The set of reflectors 8 can be described as being indicative of a very clear night sky with a large number of closely adjacent stars. However, the areas of the luminant spots 9 and 10 are not the sole criterion which must be taken into consideration in order to avoid glare. A second parameter which must be taken into consideration is the distance b (see FIG. 3) of neighboring spots 9, 10 from each other. The distance b must be selected in such a way that the eye of an observer can still discern individual luminant spots when looking at the optical system 7 at the distance a from the reflectors 8. In other words, the eye of the observer looking at the reflectors 8 from the surface 11 to be illuminated should not perceive a single luminant spot but rather a large number of discrete luminant spots. It has been found that the distance b is highly satisfactory, i.e., that the observer can readily discern neighboring luminant spots, if it is calculated in accordance with the equation $$b=2\times a\times \tan(y/2),$$

wherein a is the aforementioned distance of the surface 11 from the luminant spots 9 and 10 (measured in meters) and y (measured in angular minutes) equals or exceeds ten. Referring to FIG. 3, an eye at the surface 11 (i.e., at a distance a from the luminant spots 9 and 10) will readily perceive both spots if the distance b is calculated in accordance with the preceding equation. The angle y/2 (as well as the angle x/2 in FIG. 2) is exaggerated for the sake of clarity. This angle y/2 is assumed to exceed ten angular minutes.

FIGS. 2 and 3 show that the areas of the luminant spots 9 and 10 can be increased if the distance a from the surface 11 is increased. Inversely, the distance b between neighboring spots 9, 10 must be reduced if the distance a of the reflectors 8 from the surface 11 is reduced. The distance b must be increased if the distance a is increased.

The light source 2 preferably emits light having a density in excess of 100,000 candles or candelas per square meter. In many instances, the density of light which is emitted by the source 2 will reach or exceed 15,000,000 candles per square meter. This causes the observer to perceive very bright illuminated surfaces. However, such high light intensity does not result in glare as long as the dimensions of the luminant spots 9, 10 and the distances b between neighboring spots satisfy the aforediscussed requirements for prevention of glare.

Glare can also develop as a result of indirect illumination, e.g., in the case of a wet floor, as a result of impingement of light upon metallic parts or upon parts which consist or contain glass and/or as a result of impingement of light upon bright surfaces such as those of paper or markers. By looking at such reflecting surfaces, an observer might perceive a mirror image of the reflector set with a plurality of bright spots. However, and since the mutual distance of such reflected bright spots is the same as the mutual distance of luminant spots on the surfaces of the reflectors 8, the aforediscussed indirect illumination will not result in glare provided that the distances b are selected in a manner as described above with reference to FIG. 3. This renders it possible to put the improved illuminating apparatus 1 to a number of uses, for example, at railroad stations for illumination of the area including metallic railroad tracks which (in the absence of the aforedescribed selection of the size and mutual spacing of luminant spots) could cause indirect glare as a result of reflection of light on the metallic tracks. Another possible utilization of the improved apparatus is as a means for illuminating large uncovered surfaces which reflect light when wet. For example, if the large uncovered surface is the surface of a layer of asphalt, indirect glare when the asphalt layer is wet is just as unlikely to develop as direct glare as a result of looking at the optical system 7.

The dimensions of the reflectors 8 are dependent on the concavity of their light reflecting surfaces as well as upon the distance of the projectors 4 of the light source 2 from the optical system 7. The virtual reflected images of the projectors 4 upon the reflectors 8 decrease if the distance of the projectors 4 from the reflectors 8 is increased. It is advisable to select the level of the projectors 4 to be above the eye of the observer in such a way that the eye cannot (accidentally) look directly at the projectors. However, if the projectors 4 cannot be installed at a level sufficiently above the eye of the observer of reflectors 8, the improved apparatus 1 can be equipped with suitable screens for the projectors and/or the projectors can be oriented in such a way that the light beams 6 which are emitted thereby are at least substantially parallel This renders it possible to achieve high light intensities without resorting to tall supports 3 for the light source 2 and optical system 7. For example, limits upon the height of the support or supports 3 must be imposed when the improved illuminating apparatus 1 is put to use in a tunnel or at an airport.

FIG. 4 illustrates schematically an optical system 7 which includes a set of sixty four reflectors 8. Such set is composed of sixteen groups of four reflectors each (i.e., four times as many groups as in the system of FIG. 1). As already mentioned above, the optical system which utilizes reflectors can and normally does comprise at least one hundred (or a multiple of one hundred) discrete reflectors. Each group of four reflectors 8 is installed in a common holder 12 which is adjustably mounted in a frame 13 by adjustment facilitating means serving to permit movements of holders 12 relative to the frame 13. The movement facilitating means comprises an auxiliary frame 14 for each holder 12 (see FIGS. 5, 6 and 7), two coaxial pivot members 15 between the auxiliary frame 14 and the holder 12, and two coaxial pivot members 16 between the auxiliary frame 14 and the adjacent portion of the frame 13. The axes of coaxial pivot members 15 and 16 preferably cross each other at the center of the respective group of four reflectors 8. It is presently preferred to divide the optical system 7 into groups each of which contains four, five, six, seven or eight reflectors 8. The frame 13 is mounted on the support 3. The common axis of the pivot members 15 for a holder 12 can be a vertical axis (see FIG. 5), and the common axis of the pivot members 16 for an auxiliary frame 14 can be a horizontal axis. Thus, the two axes make an angle of 90° or close to 90°.

An advantage of the feature that the axes of the pivot members 15 and 16 cross the central portion of the respective group of reflectors 8 (in a common holder 12) is that any changes of orientation of the holders 12 relative to the frame 13, light source 2 and support 3 entail only minimal changes of the distance of reoriented reflectors 8 from the light source 2. It has been found that the change of distance of a reflector 8 from the light source 2 in response to pivoting of the corresponding holder 12 about the common axis of the respective pivot members 15 and/or about the common axis of the respective pivot members 16 is negligible and need not be compensated for.

All reflectors 8 of the optical system 7 can have the same size and/or shape. Alternatively, at least the reflectors 8 of each group (in a common holder 12) can be identical or substantially identical. Care should be taken during assembly of reflectors 8 with the holders 12 that the four reflected virtual images of the light source 2 (it being assumed that a group contains four reflectors 8 as shown in FIG. 5), i.e., the four luminant light directing spots 9, 10 within a holder 12, are disposed at or in excess of a minimum acceptable distance b from each other and that their maximum dimensions D do not exceed the permissible value. Further adjustments (such as the orientation of neighboring holders 12 relative to each other) can be carried out subsequent to mounting of the optical system 7 on the support 3. For example, the orientation of holders 12 in the frame 13 can be selected in such a way that the eye of an observer looking at the optical system 7 from a point on the surface 11 will perceive the luminant spots 9, 10 on each second or each third holder 12.

The construction of the illuminating apparatus which is described in the aforementioned Swiss Pat. No. 627 252 is based on the premise that glare can be reduced or eliminated by reducing the luminous intensity of the image of the light source, i.e., by reducing the luminous intensity of a point or detectable illuminated spot. This imposes limits upon the brightness of the surface to be illuminated. In accordance with the present invention, the luminous intensity of each individual point, i.e., of each discrete luminant spot, can be increased practically at will as long as one ensures that the dimensions of the spots do not exceed a predetermined maximum value D, namely a value which is dependent upon the distance of luminant spots from the surface to be illuminated. As already mentioned above, the dimensions of the luminant spots can be increased if the distance from the surface to be illuminated is increased and vice versa. A second prerequisite which must be satisfied in order to permit a practically unlimited increase of luminous intensity is to ensure that the distance between neighboring spots at least matches a predetermined minimum value.

Though the physiological processes of glare are still not entirely clear, it is assumed that a reduction of the area of a luminant spot entails the response from or excitation of a single sensory end organ in the retina of the eye of an observer. If the area of a luminant spot is increased, this causes excitation of several sensory end organs which, in turn, results in an instinctively regulated contrast amplification which inhibits the sensory end organs of the retina at one side of the light-dark boundary but causes more pronounced activation of sensory end organs at the other side of such boundary. When the light density in the surrounding area is normal, the just discussed contrast intensification results in increased visual performance but will result in sensation of glare if the density of light is very high. The minimal distance of neighboring luminant spots from each other is determined by the limited resolution capability of the human eye. When the distance b is reduced below a predetermined minimum value, the human eye is incapable of discerning each of two neighboring luminant spots. Thus, each of two neighboring luminant spots then individually excites a single sensory end organ of the retina; however, the excited sensory end organs are adjacent one another so that this results in the aforediscussed contrast amplification. The distance b is also a function of the distance a, namely the distance b can be reduced if the distance a is reduced and vice versa.

As already mentioned above, the maximum dimensions of a luminant spot are also dependent upon the nature of luminant substance or substances which are utilized in the light source. It is believed that the sensation of glare is influenced, among others, by the color or hue of light; the color, in turn, is dependent upon the nature of the luminant substance(s) in the light source.

Glare is a subjectively evaluated sensation which depends upon a number of parameters, among others the age and the general condition of the observer. Furthermore, the sensation of glare is intensified if the observer is tired or has consumed a certain quantity of alcohol, i.e., if the circumstances are the same a person is less likely to be discomforted by glare if such person is not tired and/or has not consumed an alcoholic beverage. If $B=6$, at least some of a larger number of observers will experience a slight discomfort due to glare, especially if the observers include senior citizens and/or if one can assume that certain observers are tired at the time their sensation of glare is being tested. As mentioned above, the factor B is then preferably reduced to five or less; the sensation of glare is highly unlikely to develop if the factor B is reduced to four and is practically nil if $B=1$.

It is often preferred to employ a large number of reflectors 8, e.g., four hundred. This renders it possible to establish an equally large number of luminant spots which do not create the sensation of glare but ensure bright illumination of the surface 11 and of the adjacent area. Adjustability of reflectors 8, either individually or in groups (e.g., in groups of between four and eight), is desirable and advantageous because this enhances the flexibility and versatility of the improved apparatus, i.e., one and the same apparatus can be used for a number of different purposes. Another advantage of such adjustability is that the ultimate orientation and mutual spacing of reflectors 8 can be selected at the locale of use rather than at the manufacturing plant.

Though it is within the purview of the invention to employ a number of reflectors 8 each of which is adjustable (e.g., pivotable about two mutually inclined axes as shown in FIGS. 5 to 7) independently of each other reflector, it normally suffices to jointly adjust a group of between four and eight reflectors. This reduces the cost because the positions of reflectors 8 in a common holder 12 can be fixed in the manufacturing plant, and this also reduces the cost of installation of the apparatus 1 at the locale of actual use. The holders 12 are mounted in the frame 13 in such a way that each holder can be moved to a position in which light issuing from the source 2 impinges upon the respective group of reflectors 8. The selection of that number of holders 12 whose reflectors 8 are to reflect light upon the surface 11 is thereupon selected after the apparatus 1 is already erected at the locale of use.

An advantage of mounting of each holder 12 for pivotal movement about two crossing axes is that each holder can be adjusted in several directions. Furthermore, such adjustability enables the persons in charge of selecting the orientation of holders 12 in the frame 13 of an erected optical system 7 to position the holders in such a way that each unit area of the surface 11 is illuminated to the same extent or that the illumination of selected areas of such surface is more pronounced than the illumination of other areas of the same surface.

The utilization of holders 12 with between four and eight reflectors 8 has been found to be particularly advantageous because such holders can be mass produced at a reasonable cost and can be used for assembly into frames 13 of different sizes and/or shapes. Moreover, the luminant spots 9, 10 which are produced by reflectors in a holder 12 having up to eight reflectors can be readily spaced apart to be individually discernible to the eye of a person at a distance a from the reflectors. Though the mutual spacing of luminant spots which are produced by reflectors in a holder containing a large number of reflectors (i.e., well in excess of eight) can also be selected to satisfy the aforediscussed prerequisites for elimination or reduction of glare, the cost is much higher than in connection with the production of holders 12 with not more or not appreciably more than eight reflectors.

Reflectors 8 with concave light reflecting surfaces are preferred at this time because they ensure that an observer can discern the virtual reflected image of the light source in the form of a discrete spot. The luminant spot of a reflector is much smaller than the luminant surface of the light source. This renders it possible to achieve relatively small luminant spots and desirable pronounced mutual spacing of neighboring luminant spots from one another.

Though the improved apparatus can employ a light source which comprises a single lamp, it is presently preferred to employ a composite light source with a plurality of projectors which are preferably oriented in such a way that they direct light beams 6 in a single direction. If such single direction is not toward the surface 11, i.e., if the light beams 6 cannot reach the eye of an observer at the surface 11, the danger of glare as a result of direct exposure to radiation from the light source is nil. If the light source comprises a number of projectors, the optical system 7 exhibits a larger number of luminant spots and each such spot contributes to brightness of the surface 11. At the same time, the individual luminant spots can be sufficiently small to eliminate or greatly reduce the likelihood of glare. The projectors 4 of the light source 2 are preferably spaced apart from each other. The mutual spacing of projectors 4 influences the spacing of luminant spots at the light reflecting surfaces of the reflectors 8, i.e., the virtual mirror images of individual projectors 4 are disposed at a desirable minimum distance or at a greater than minimum distance from each other.

Light sources which emit light having a density of 100,000 candles per square meter are available on the market. Such density often suffices to ensure that a selected surface and the area adjacent the surface exhibit the required brightness. The density of emitted light can be increased practically at will. As mentioned above, the density of light issuing from the source 2 can be in the range of 15,000,000 candles per square meter without causing any glare or any uncomfortable glare.

Figure 8:
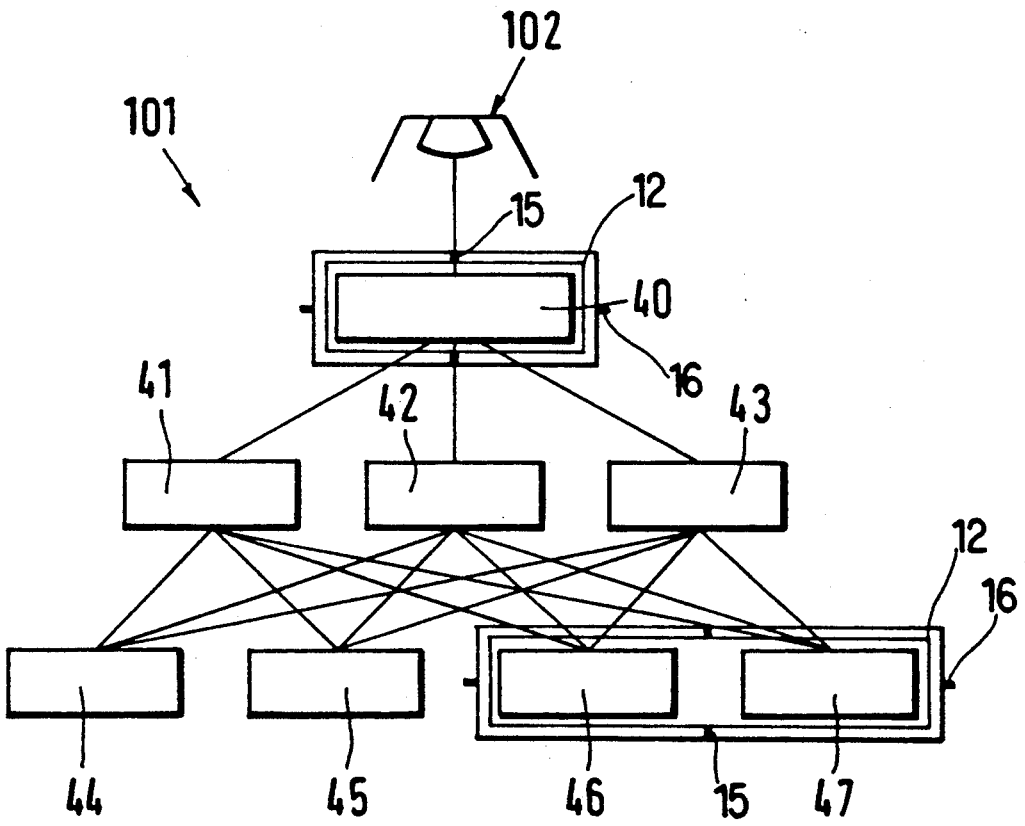
FIG. 8 is a diagrammatic view of a modified illuminating apparatus wherein the optical system comprises a plurality of light transmitting lenses.

The heretofore described optical system 7 which employs a number of reflectors 8 constitutes but one form of the means for dividing light which issues from the light source into light beams and for directing such light beams against each unit area of a surface to be illuminated. As shown in FIG. 8, light which is emitted by a source 102 forming part of an illuminating apparatus 101 can impinge upon a system or array of light transmitting and dispersing or collecting (rather than light reflecting) lenses including a first lens 40 which is located in the path of light issuing from the source 102 and several additional lenses 41–47. The lenses 41, 42 and 43 are located in a common plane and each of these lenses receives dispersed light from the lens 40. The lenses 44, 45, 46 and 47 are also located in a common plane, and each of these lenses receives dispersed light from each of the lenses 41, 42 and 43.

The lines which are shown in FIG. 8 between the lens 40 and the lenses 41–43, and the lines which are shown between the lenses 41–43 and each of the lenses 44–47 each represent a single light beam or a plurality of light beams. As a rule, each of the lenses 41–43 will receive a three-dimensional light beam of predetermined size rather than a point-shaped light beam, and the same holds true for the light beams which impinge upon the lenses 44–47.

It goes without saying that the shapes of the lenses 40–47 will be selected with a view to ensure that the lenses 44–47 will establish luminant spots having a mutual spacing b as described hereinbefore and maximum dimensions D which satisfy the aforediscussed requirements.

It is further clear that the number of lenses in the optical system of the apparatus 101 can be greatly increased, e.g., by adding one or more sets of discrete lenses in the path of light which is transmitted and directed by the row of lenses 44–47. Furthermore, the lenses of one or more rows are preferably adjustable in order to change the orientation of their optical axes. This can be achieved by mounting the lenses in holders corresponding to the holders 12 with each holder adjustably supporting by pivot members 15, 16 and by mounting the holders for individual lenses or for groups of lenses in a frame corresponding to the frame 13. The arrangement may be such that the group of lenses 44–47 can be adjusted as a unit by mounting them in a common holder which is pivotable and/or otherwise movable relative to a frame or the like. The lenses of the optical system in the illuminating apparatus can include collector lenses and/or light dispersing lenses.

The illuminating apparatus 101 (or an analogous apparatus wherein the optical system comprises lenses in lieu of reflectors) can be used with advantage when the available space does not suffice to install a light source 2 at a requisite distance from an optical system 7 of reflectors 8. Thus, and as shown in FIG. 8, the light source 102 can be located at a level above the optical system including the lenses 40–47. This reduces the likelihood of direct impingement of light issuing from the source 102 into the eye of an observer and/or the danger which is inherent when a very hot light source is placed close to the ground, e.g., because such light source must be installed at a level beneath a system of reflectors 8.

An advantage of an apparatus with adjustable discrete lenses or with adjustable groups of lenses is that such apparatus can be put to a number of different uses, the same as an apparatus 1 which employs adjustable reflectors 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for illuminating a surface, comprising a light source; and optical means for dividing light which issues from said light source into light beams, including means for directing against each unit area of said surface a plurality of light beams, said directing means having at least one array of luminant light directing spots disposed at a first distance from said surface, each of said luminant light directing spots having a maximum dimension which is a function of said first distance and does not cause uncomfortable glare to the eye looking at said surface irrespective of the intensity of light from said light source, said luminant light directing spots being spaced apart from each other a second distance sufficient to render such luminant light directing spots distinguishable to the eye at said first distance.

2. The apparatus of claim 1, wherein said light source includes a luminescent substance and said maximum dimension of each of said luminant light directing spots in a function of the nature of said luminescent substances.

3. The apparatus of claim 1, wherein said second distance is defined by the equation $b=2\times a\times \tan(y/2)$, wherein b is said second distance, a is said first distance in meters, and y equals or exceeds ten angular minutes.

4. The apparatus of claim 1, wherein said light dividing means includes at least one set of adjustable light reflectors.

5. The apparatus of claim 4, wherein said at least one set of adjustable light reflectors includes a plurality of groups of adjustable light reflectors and the adjustable light reflectors of each group of said plurality of groups are adjustable as a unit.

6. The apparatus of claim 5, wherein each group of said plurality of groups comprises between four and eight reflectors.

7. The apparatus of claim 4, wherein at least some of said adjustable light reflectors have substantially concave light reflecting surfaces.

8. The apparatus of claim 1, wherein said light dividing means includes a set of lenses.

9. The apparatus of claim 8, wherein said set of lenses comprises discrete lenses and at least some of said lenses are adjustable to change the orientation of their optical axes.

10. The apparatus of claim 9, wherein said at least some lenses are individually adjustable.

11. The apparatus of claim 9, wherein said at least some lenses are adjustable in groups of at least two lenses each.

12. The apparatus of claim 1, wherein said light source emits light having a density in excess of 100,000 candles per square meter.

13. Apparatus for illuminating a surface, comprising a light source; and optical means for dividing light which issues from said light source into light beams, including means for directing against each unit area of said surface a plurality of light beams, said directing means having at least one array of luminant light directing spots disposed at a first distance from said surface, each of said luminant light directing spots having a maximum dimension which is a function of said first distance and each said luminant light directing spots being spaced apart from each other a second distance sufficient to render such luminant light directing spots distinguishable to the eye at said first distance, the maximum dimension of each of said luminant light directing spots being defined by the equation $$D=2\times a\times \tan(x/2),$$

wherein D is the maximum dimension, a is the first distance in meters and $x=-1g\times \ln(K-B)/(K-1)-s$, wherein x is measured in angular minutes, g and K and B are variables, and $$0.5\leqq g\leqq 0.9$$

$$6\leqq K\leqq 9,$$

$$1\leqq B\leqq 6, \text{ and}$$

$$0\leqq s\leqq 0.3.$$

14. The apparatus of claim 13, wherein B is a function of permissible glare to the eye at said first distance from said luminant light directing spots.

15. The apparatus of claim 14, wherein B at most equals 5.

16. The apparatus of claim 15, wherein B at most equals 4.

17. Apparatus for illuminating a surface, comprising a light source; and optical means for dividing light which issues from said light source into light beams, including means for directing against each unit area of said surface a plurality of light beams, said directing means having at least one array of luminant light directing spots disposed at a first distance from said surface, each of said luminant light directing spots having a maximum dimension which is a function of said first distance and each said luminant light directing spots being spaced apart from each other a second distance sufficient to render such luminant light directing spots distinguishable to the eye at said first distance, said light dividing means including at least one set of adjustable light reflectors and said at least one set of adjustable light reflectors including a plurality of groups of adjustable light reflectors, the adjustable light reflectors of each group of said plurality of groups of adjustable light reflectors being adjustable as a unit, said light dividing means further comprising a holder for each group of said plurality of groups of adjustable light reflectors, a frame for said holders, and means for movably mounting said holders in said frame.

18. The apparatus of claim 17, wherein said means for movably mounting includes means for facilitating movements of each of said holders in a plurality of different directions.

19. The apparatus of claim 18, wherein said means for facilitating movements includes a plurality of pivot members for each of said holders.

20. The apparatus of claim 19, wherein each of said holders includes a central portion and said pivot members of said plurality of pivot members have axes extending through the central portions of the respective holders.

21. Apparatus for illuminating a surface, comprising a light source including a plurality of projectors; and optical means for dividing light which issues from said light source into light beams, including means for directing against each unit area of said surface a plurality of light beams, said directing means having at least one array of luminant light directing spots disposed at a first distance from said surface, each of said luminant light directing spots having a maximum dimension which is a function of said first distance and each said luminant light directing spots being spaced apart from each other a second distance sufficient to render such luminant light directing spots distinguishable to the eye at said first distance.

22. The apparatus of claim 21, wherein said projectors of said plurality of projectors are spaced apart from each other.

* * * * *